US008449320B2

(12) United States Patent
Dvorak

(10) Patent No.: US 8,449,320 B2
(45) Date of Patent: May 28, 2013

(54) JUMPER APPARATUS

(76) Inventor: Steven G. Dvorak, Houston, TX (US)

( * ) Notice: Subject to any disclaimer, the term of this patent is extended or adjusted under 35 U.S.C. 154(b) by 0 days.

(21) Appl. No.: 13/026,088

(22) Filed: Feb. 11, 2011

(65) Prior Publication Data

US 2011/0207367 A1 Aug. 25, 2011

Related U.S. Application Data

(60) Provisional application No. 61/307,391, filed on Feb. 23, 2010.

(51) Int. Cl.
*H01R 31/08* (2006.01)

(52) U.S. Cl.
USPC ..... 439/507

(58) Field of Classification Search
USPC ..... 439/507–514, 181
See application file for complete search history.

(56) References Cited

U.S. PATENT DOCUMENTS 2,912,603 A * 11/1959 Farnsworth ..... 307/147
4,241,975 A * 12/1980 Cooper, Jr. ..... 439/798
4,406,915 A * 9/1983 Lang ..... 174/117 F
6,383,012 B1 * 5/2002 Kisu et al. ..... 439/404
7,357,652 B1 4/2008 Arenas et al.
7,413,486 B2 * 8/2008 Pizzi ..... 439/787
RE42,022 E * 1/2011 Pizzi ..... 439/787
2006/0270271 A1 * 11/2006 Moriyama et al. ..... 439/499
2008/0207046 A1 8/2008 Arenas et al.
2009/0180261 A1 7/2009 Angelides et al.
2010/0029129 A1 * 2/2010 Cox et al. ..... 439/405
2011/0090667 A1 4/2011 Wilson et al.
2011/0207367 A1 * 8/2011 Dvorak ..... 439/507

* cited by examiner

*Primary Examiner* — Alexander Gilman
(74) *Attorney, Agent, or Firm* — Gordon G. Waggett, P.C.

(57) ABSTRACT

Apparatus is disclosed for use in electrically connecting common terminals are adjacent duplex plugs of a double duplex wall plug to one another. In one embodiment, the apparatus comprises a generally U-shaped jumper element which is fabricated from a sheet of flexible conductive material and which has a base portion and two leg portions which extend away from the base portion and which have slotted terminal lugs at their ends for connection to common terminals on adjacent duplex plugs. In another embodiment, the apparatus comprises two of the aforedescribed jumper elements which are in inverted relationship to one another and where the terminal lugs of the two jumper elements are aligned along a common axis. Flexible insulating material encloses the second embodiment and may be used to enclose the first embodiment.

7 Claims, 4 Drawing Sheets

JUMPER APPARATUS

CROSS-REFERENCE TO RELATED APPLICATION

This application claims the benefit of the filing date of U.S. Provisional Application No. 61/307,391 filed Feb. 23, 2010.

BACKGROUND OF THE INVENTION

1. Field of the Invention

This invention relates to apparatus for use in wiring a double duplex wall plug.

2. Description of the Prior Art

Double duplex wall plugs (which are sometimes referred to as quad plugs) are commonly utilized in commercial, residential and industrial applications. As illustrated in FIG. 1, a double duplex wall plug comprises two duplex wall plugs 10, 11 which are installed in a side-by-side relationship in a quad outlet box (not shown) which may be located in a wall or which may be surface mounted. Once the duplex wall plugs 10, 11 are installed in the quad outlet box, cover plate 12 is attached to the wall plugs 10, 11.

Prior to their installation in a quad outlet box, duplex plugs 10, 11 must be wired such that each of the four plugs is connected to electricity. The rear of each duplex plug 10, 11 is shown in FIG. 2, and each duplex plug comprises four terminals to which wires may be connected. Duplex plug 10 comprises terminals 13 and 14 which are customarily brass-colored and terminals 15 and 16 which are customarily silver-colored. Similarly, duplex plug 11 comprises customarily brass-colored terminals 17 and 18 and customarily silver-colored terminals 19 and 20. The terminals 13 and 14 are electrically connected to one another in the fabrication of duplex plug 10. Similarly, terminals 15 and 16 are electrically connected to one another in the fabrication of duplex plug 10, terminals 17 and 18 are electrically connected to one another in the fabrication of duplex plug 11 and terminals 19 and 20 are electrically connected to one another in the fabrication of duplex plug 11. Terminals 14 and 18 are, for example, "common terminals on adjacent duplex plugs" because they have the same voltage polarity when electricity is connected to the duplex plugs. For the same reason, terminals 16 and 20 are "common terminals on adjacent duplex plugs."

Commonly, only one pair of wires carries electricity to a double duplex wall plug. Accordingly, during the installation of such a plug, terminals 14 and 18 are connected together using a first short length of wire and terminals 16 and 20 are connected together using a second short length of wire. The pair of wires which will carry the electricity to the double duplex wall plug may then be connected to terminals 13 (black wire) and 19 (white wire).

The process of connecting terminals 14 and 18 together and terminals 16 and 20 together, using short lengths of wire is very tedious and time-consuming. First, two short lengths of wire must be cut and then stripped of insulation at the end of each short length of wire. Next, the stripped portion of each end of each short length of wire is formed into a loop for engaging a terminal on the duplex plug. The short lengths of wire must then be connected to the appropriate terminals on the duplex plugs. The above process is exacerbated by the fact that 12 gauge wire is mandated for use in the wiring of such plugs and the formation of the short lengths of wire from 12 gauge wire as described above is difficult.

SUMMARY OF THE INVENTION

In accordance with the present invention, apparatus is provided for use in electrically connecting common terminals on adjacent duplex plugs of a double duplex wall plug to one another. In one embodiment, apparatus according to the present invention comprises a generally U-shaped jumper element which is fabricated from a sheet of flexible conductive material having two sides and a predetermined thickness and which comprises a base portion and first and second leg portions of a predetermined width. The first and second leg portions extend away from the base portion and have slotted terminal lugs at their ends for connection to the common terminals on adjacent duplex plugs.

The foregoing apparatus may further comprise flexible insulating material which encloses the jumper element. In one embodiment, the flexible insulating material is a flexible potting resin which encapsulates the jumper element. In yet another embodiment, the flexible insulating material comprises insulating tape which it is attached to each side of the conductive material.

In yet another embodiment, apparatus according to the present invention comprises two generally U-shaped jumper elements which are fabricated from a sheet of flexible conducting material having two sides and a predetermined thickness and which are arranged in inverted relationship to one another. Each said jumper element comprises a base portion and first and second leg portions of a predetermined width which extend away from the base portion and which have slotted terminal lugs at their ends for connection to the terminals on adjacent duplex plugs. In this embodiment, the slotted terminal lugs of the two jumper elements are aligned along a common axis. Flexible insulating material encloses the two jumper elements, and the flexible insulating material may comprise a flexible potting resin which encapsulates the jumper elements or a flexible insulating tape which is attached to each side of the conductive material.

DESCRIPTION OF THE SPECIFIC EMBODIMENTS

It will be appreciated that the present invention may take many forms and embodiments. In the following description, some embodiments of the invention are described and numerous details are set forth to provide an understanding of the present invention. Those skilled in the art will appreciate, however, that the present invention may be practiced without those details and that numerous variations and modifications from the described embodiments may be possible. The following description is thus intended to illustrate and not to limit the present invention.

Figure 3:
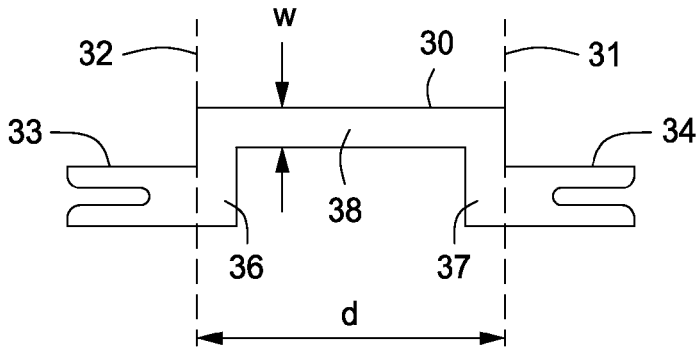
FIG. 3 is a top view of an embodiment of a jumper element in accordance with the present invention.
Figure 4:
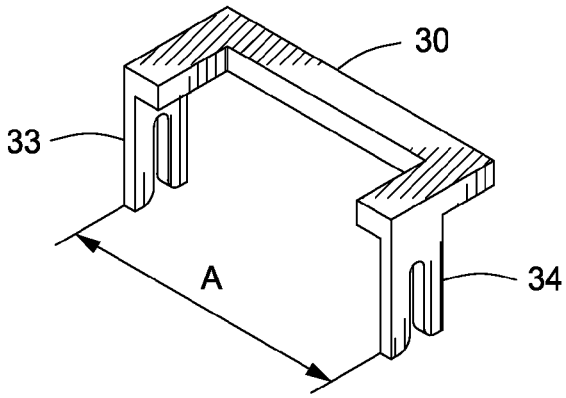
FIG. 4 is a perspective view of the jumper element of FIG. 3 with the leg portions of jumper elements 30 containing slotted terminal lugs 33 and 34 then downward.

With reference now to FIGS. 3 and 4, one embodiment of apparatus in accordance with the present invention comprises two generally U-shaped jumper elements 30. Each jumper element 30 is fabricated as follows: A structure as shown in FIG. 3 is stamped or cut from a sheet of flexible conductive material such as copper having a predetermined thickness which is preferably 0.032 inches. Jumper element 30 comprises a base portion 38 and two leg portions 36, 37 which extend away from the base portion 38. The width w of the base portion and the leg portions of each U-shaped jumper element 30 is preferably 3/16 inches. The foregoing dimensions for the thickness of the conductive material and the width of the base and leg portions result in a jumper element which is electrically equivalent to 12 gauge wire.

Still referring to FIGS. 3 and 4, each leg portion 36, 37 of jumper element 30 has slotted terminal lugs (or tangs) 33 and 34 at its ends. The leg portions having slotted terminal lugs 33 and 34 are then bent 90° along the lines 32 and 31, respectively. The distance d between the lines 31 and 32 is equal to: (a) the distance between common terminals 14 and 18 of duplex plugs 10 and 11, respectively, when the duplex plugs are installed in a quad box; and (b) the distance between common terminals 16 and 20 of duplex plugs 10 and 11, respectively, when the duplex plugs are installed in a quad box.

Figure 2:
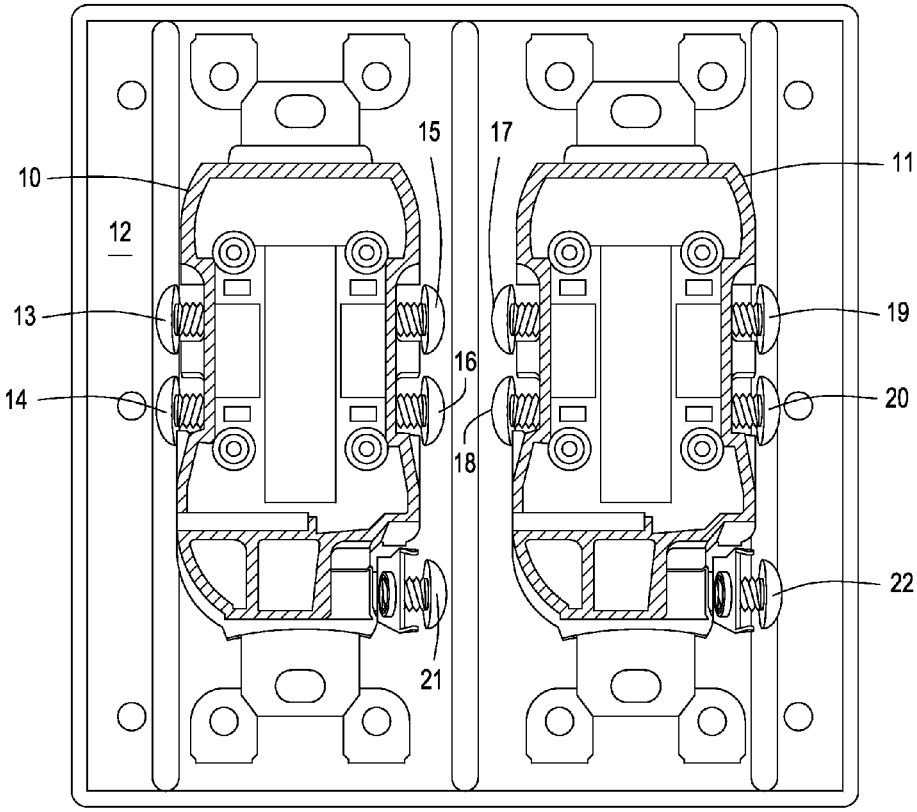
FIG. 2 is an elevation view of the rear of a typical double duplex wall plug.
Figure 5:
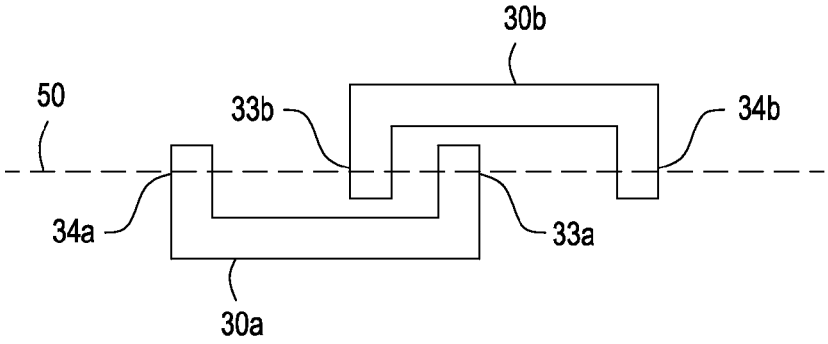
FIG. 5 is a top view showing the relationship of two of the jumper elements of FIG. 3 when they are attached to the terminals of the duplex plugs of FIG. 2.
Figure 6:
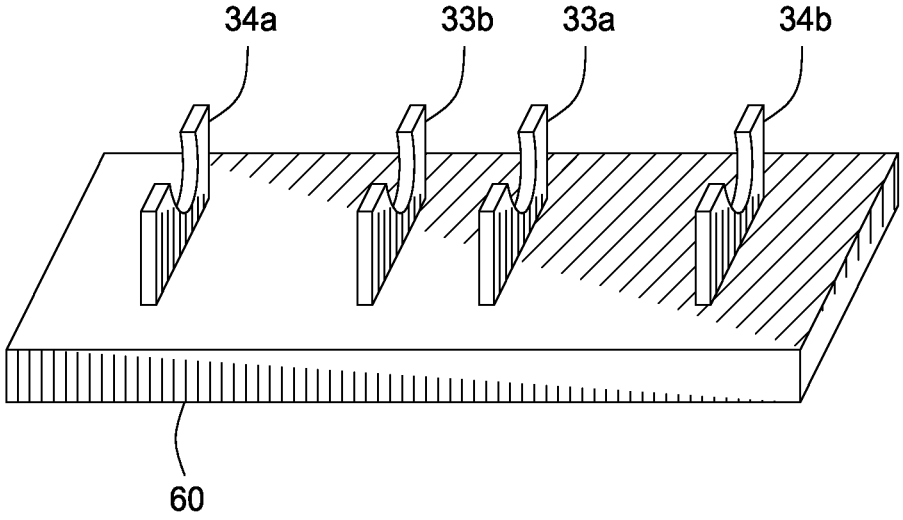
FIG. 6 is a perspective view of the two jumper elements of FIG. 5 after encapsulation.

Referring now to FIG. 5, one embodiment of apparatus in accordance with the present invention is fabricated by placing two jumper elements 30 (which are designated 30*a* and 30*b* in FIG. 5) in an inverted position with respect to one another as shown such that the slots in slotted terminal lugs 34*a*, 33*b*, 33*a* and 34*b* are in alignment along the axis 50 and such that the distance between slotted terminal lugs 33*a* and 33*b* is equal to the distance between terminals 16 and 18 (FIG. 2). The aforesaid placement may advantageously be accomplished by placing the two jumper elements 30*a* and 30*b* in a jig (not shown) into which flexible potting resin, either thermoplastic or catalyzed, may be poured to encapsulate jumper elements 30*a* and 30*b* and to insulate those jumper elements from one another. A jumper strip 60 comprising encapsulated jumper elements 30*a* and 30*b* is illustrated in FIG. 6.

Figure 1:
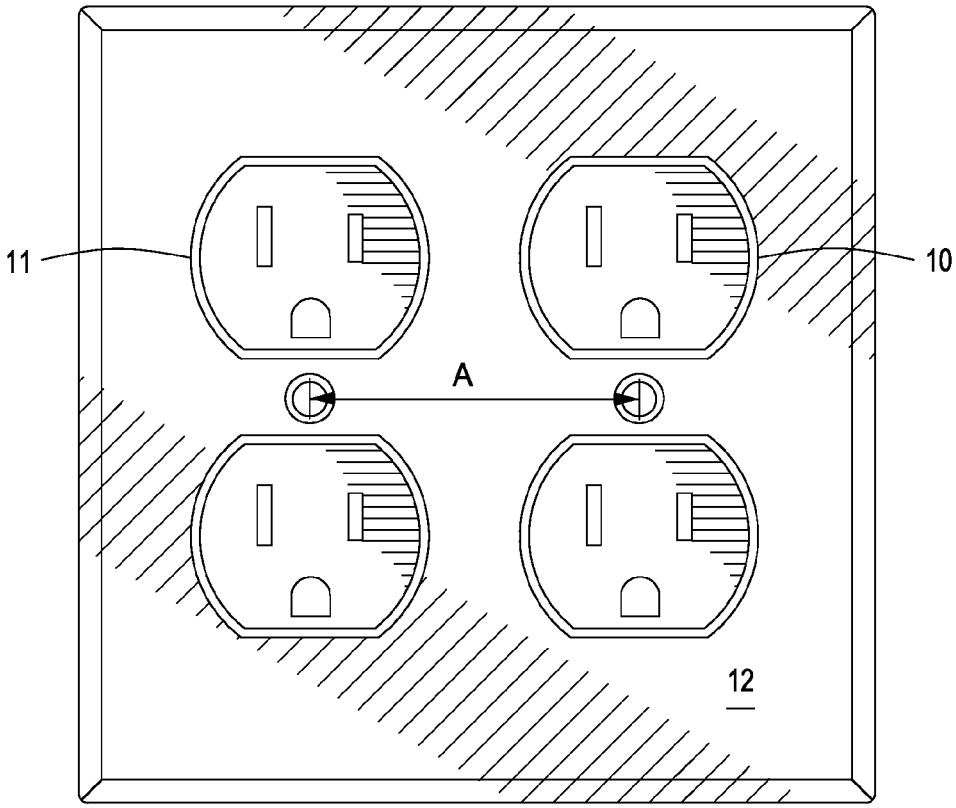
FIG. 1 is an elevation view of the front of a typical double duplex wall plug.

Once the jumper strip 60 is fabricated, it may be installed on the duplex plugs 10, 11 of FIG. 2 as follows: Slotted terminal 34*a* engages terminal 14, slotted terminal 33*b* engages terminal 16, slotted terminal 33*a* engages terminal 18, and slotted terminal 34*b* engages terminal 20. The screws associated with terminals 14 and 20 may then be tightened. Next, duplex plugs 10 and 11 are flexed so as to allow terminals 16 and 18 to be exposed so that they may be tightened. When so assembled, the spacing between lugs 33 and 34 matches the center-to-center dimension A of customary boxes and wall plates (see FIGS. 1 and 5).

An alternative method of fabricating a jumper strip in accordance with the present invention would be to use two strips of insulating tape instead of a flexible potting resin. One strip of the insulating tape would be formed with holes through which slotted terminal lugs 34*a*, 33*b*, 33*a* and 34*b* may be allowed to protrude. The second strip of insulating tape may then be attached to the opposite sides of jumper elements 30*a* and 30*b*.

With reference to FIGS. 2-4, a jumper element 30 may be utilized, with or without insulation, to connect ground terminals 21 and 22 of duplex plugs 10 and 11, respectively, to one another. The slotted terminal lugs 33 and 34 may be offset as illustrated in FIG. 4, but such offset is not necessary when using jumper element 30 to connect ground terminals 21 and 22 to one another.

What is claimed is:

1. Apparatus for use in electrically connecting common terminals on adjacent duplex plugs of a double duplex wall plug to one another, comprising:

a jumper element which is fabricated from a sheet of flexible conductive material having two sides and a predetermined thickness and which comprises a base portion and first and second leg portions of a predetermined width, said first and second leg portions extending away from said base portion to generally form a U-shape in a first plane, said first and second leg portions having slotted terminal lugs at their ends extending outwardly therefrom in the same direction in a second plane perpendicular to said first plane for connection to the common terminals on the adjacent duplex plugs.

2. The apparatus of claim 1, further comprising a flexible insulating material which encloses the jumper element.

3. The apparatus of claim 2, wherein the insulating material comprises a flexible potting resin which encapsulates the jumper element.

4. The apparatus of claim 2, wherein the insulating material comprises flexible insulating tape which is attached to each side of the conductive material.

5. Apparatus for use in electrically connecting common terminals on adjacent duplex plugs of a double duplex wall plug to one another, comprising:

two jumper elements which are fabricated from a sheet of flexible conductive material having two sides and a predetermined thickness and which are arranged in inverted relationship to one another, where: (i) each said jumper element comprises a base portion and first and second leg portions of a predetermined width, said first and second leg portions extending away from said base portion to generally form a U-shape in a first plane, said first and second leg portions having slotted terminal lugs at their ends extending outwardly therefrom in the same direction in a second plane perpendicular to said first plane for connection to the terminals on the adjacent duplex plugs; and (ii) the slotted terminal lugs of the two jumper elements are aligned along a common axis; and flexible insulating material which encloses the two jumper elements.

6. The apparatus of claim 5, wherein the insulating material comprises a flexible potting resin which encapsulates the jumper element.

7. The apparatus of claim 5, wherein the insulating material comprises flexible insulating tape which is attached to each side of the conductive material.

* * * * *